US006719380B1

(12) United States Patent
Liu

(10) Patent No.: US 6,719,380 B1
(45) Date of Patent: Apr. 13, 2004

(54) TOOL CABINET

(76) Inventor: Heng-Chia Liu, No. 11, Lane 361, Fengjou Rd., Shengang Hsiang, Taichung Hsien (TW)

( * ) Notice: Subject to any disclaimer, the term of this patent is extended or adjusted under 35 U.S.C. 154(b) by 0 days.

(21) Appl. No.: 10/347,201

(22) Filed: Jan. 21, 2003

(51) Int. Cl.[7] ..... E05B 65/46
(52) U.S. Cl. ..... 312/218; 312/217
(58) Field of Search ..... 312/217, 218, 312/221, 290

(56) References Cited

U.S. PATENT DOCUMENTS 2,930,666 A * 3/1960 Ibel ..... 312/218
3,150,902 A * 9/1964 Naab ..... 312/217
4,721,347 A * 1/1988 Kritselis ..... 312/219
6,378,963 B1 * 4/2002 Relyea et al. ..... 312/218
6,572,203 B1 * 6/2003 Cheng ..... 312/217

* cited by examiner

*Primary Examiner*—Peter R. Brown
(74) *Attorney, Agent, or Firm*—Rosenberg, Klein & Lee

(57) ABSTRACT

A tool cabinet has a stand, a drawer frame, an upper case, multiple drawers and a locking device. The locking device is mounted in the upper case to keep the drawer from sliding out from the drawer frame. The locking device has a parallelogram four-bar assembly, an upper bar, at least one locking bar and multiple locking tabs attached to the drawers. The locking bar has multiple locking holes corresponding and engaging with the locking tabs on the drawer. Accordingly, the drawers can be held in place by the locking device to keep drawers from unintentionally sliding out from the cabinet. This can keep any person from being injured by the drawers, and the safety of using and transporting the cabinet is improved.

19 Claims, 8 Drawing Sheets

TOOL CABINET

BACKGROUND OF THE INVENTION

1. Field of the Invention

The present invention relates to a tool cabinet, and more particularly to a tool cabinet with a locking device for keeping drawers from unintentionally sliding out from the cabinet.

2. Description of Related Art

With reference to FIG. 8, a conventional tool cabinet (90) comprises a stand (92), a drawer frame (95), an upper case (94) and multiple drawers (96). The drawer frame (95) is attached to the stand (92), and the upper case (94) is attached to the top of the drawer frame (95). The drawers (96) are moveably received in the drawer frame (95). With such a cabinet (90), tools, such as hammers, wrenches and so on, can be put into and held in the upper case (94) and the drawers (96). In addition, multiple wheels (93) are attached to the stand (92), such that the cabinet (90) with tools can be easily transported to any desired place for use.

However, because there is no locking device for the drawers (96) mounted in the conventional tool cabinet (90), the drawers (96) easily escape from the drawer frame (95) when the cabinet (90) is being moved or transported. The tools are usually heavy and sometimes sharp so that a person who is near the cabinet (90) may be seriously injured when a laden drawer (96) slides.

To overcome the shortcomings, the present invention tends to provide a tool cabinet to mitigate or obviate the aforementioned problems.

SUMMARY OF THE INVENTION

The main objective of the invention is to provide a tool cabinet with a locking device to keep drawers from unintentionally sliding out from the cabinet. The tool cabinet has a stand, a drawer frame, an upper case, multiple drawers and a locking device. The locking device is mounted in the upper case to keep the drawers from sliding out from the drawer fame such that a person can be safe from injury by the drawers, and the safety of using and transporting the cabinet is improved.

Other objects, advantages and novel features of the invention will become more apparent from the following detailed description when taken in conjunction with the accompanying drawings.

DETAILED DESCRIPTION OF PREFERRED EMBODIMENT

Figure 1:
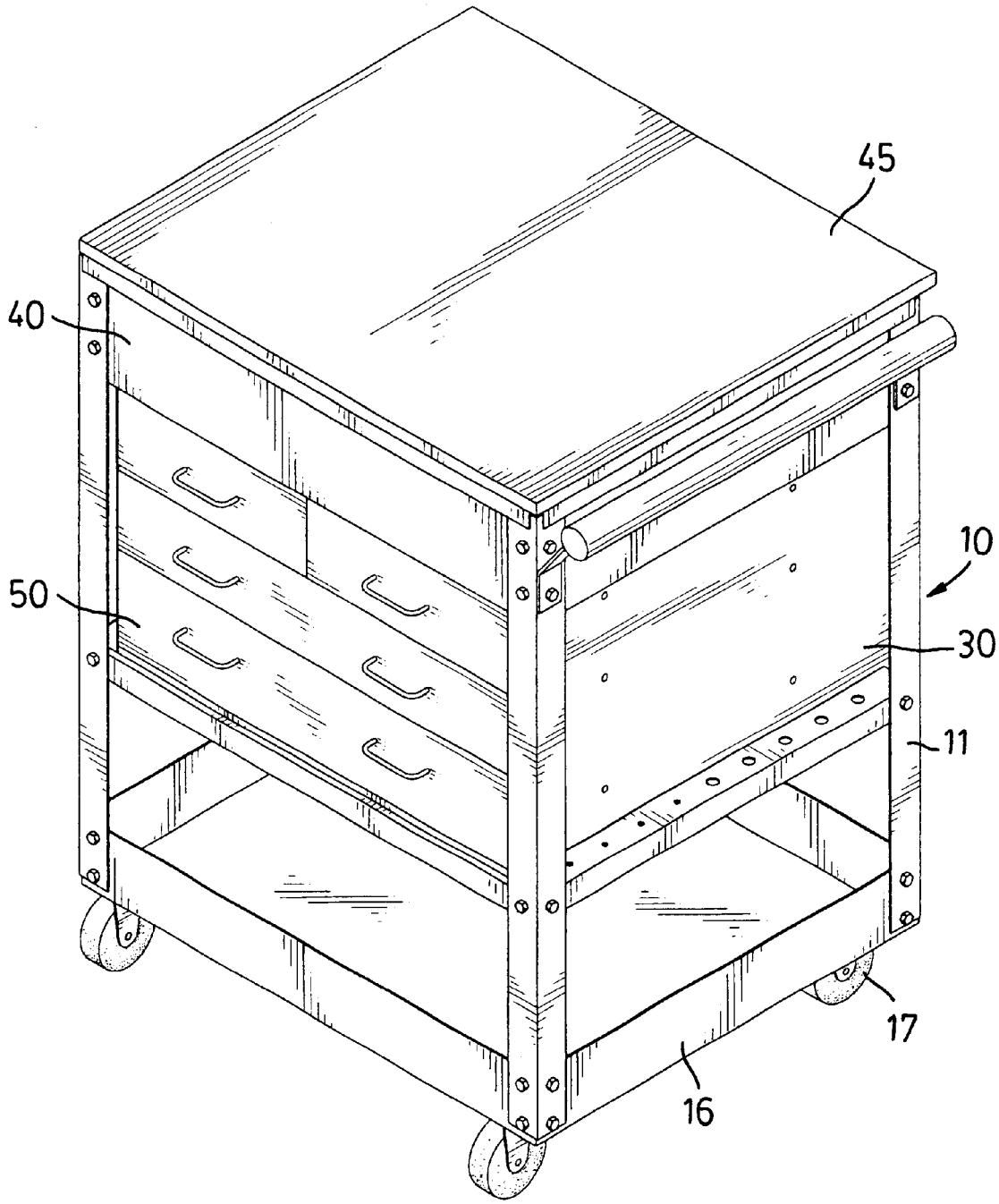
FIG. 1 is a perspective view of a tool cabinet in accordance with the present invention.
Figure 2:
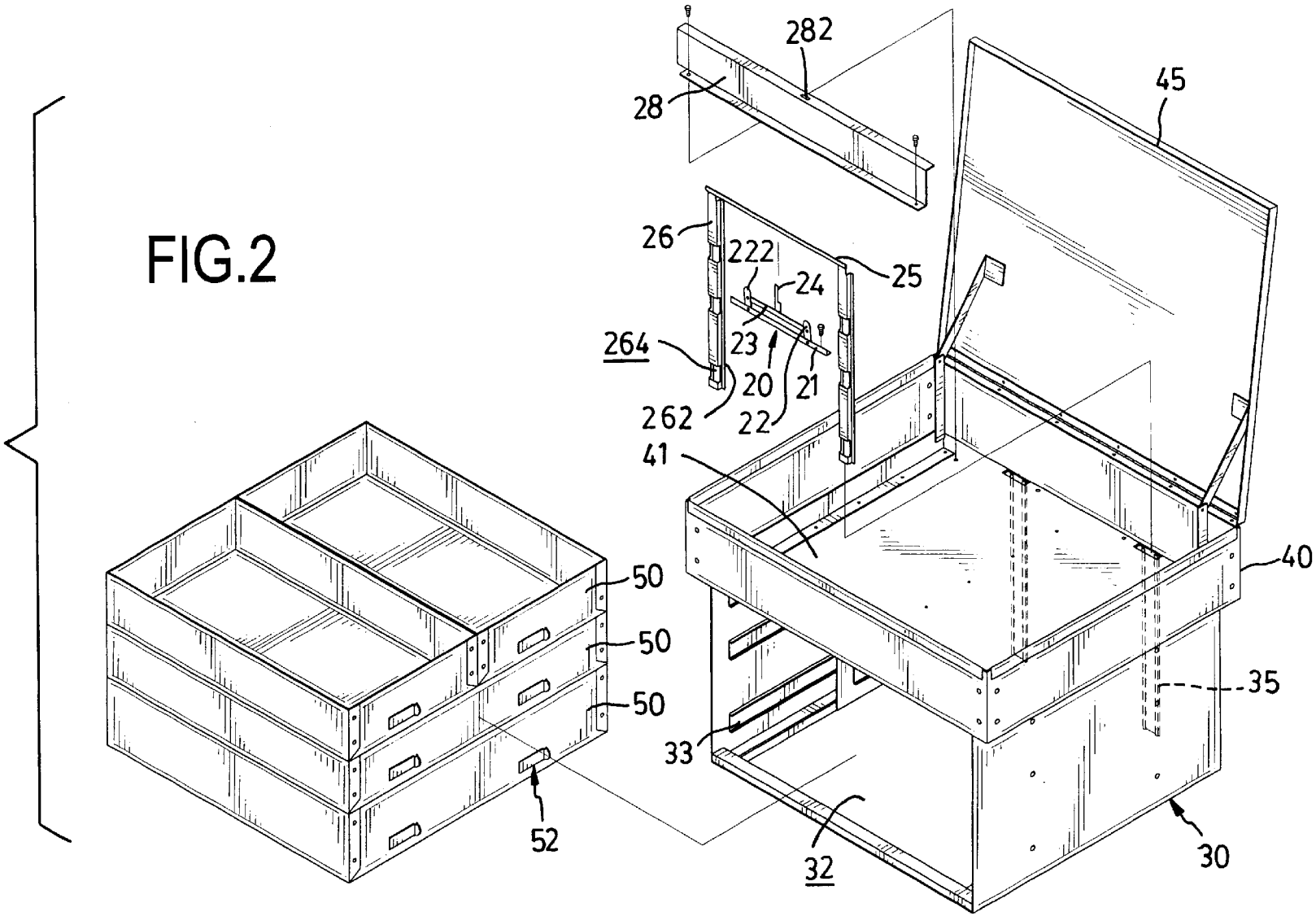
FIG. 2 is an exploded perspective view of the drawer frame, the drawers and the locking device of the tool cabinet in FIG. 1.
Figure 3:
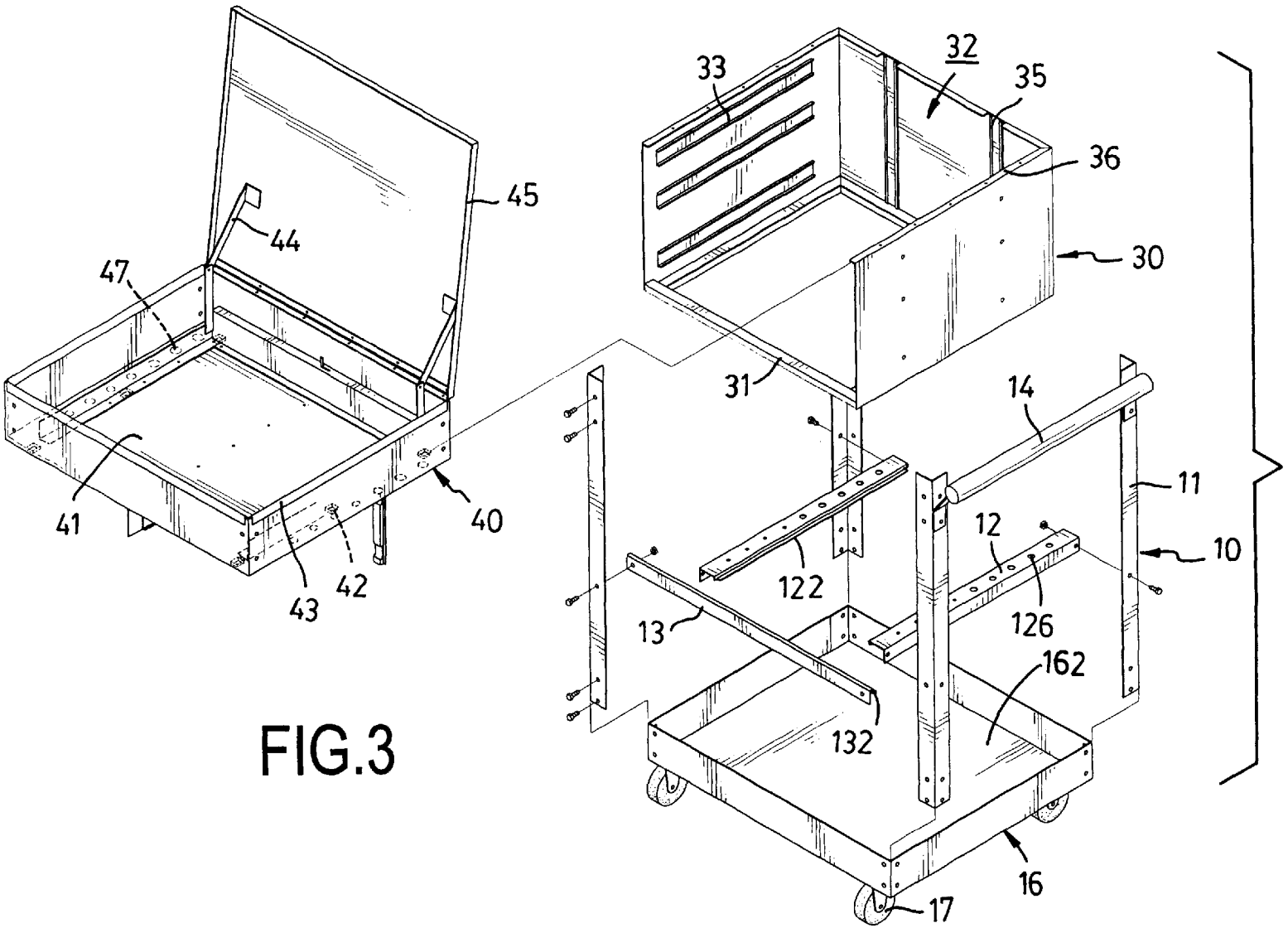
FIG. 3 is an exploded perspective view of the stand, the drawer frame and the upper case of the tool cabinet in FIG. 1.
Figure 4:
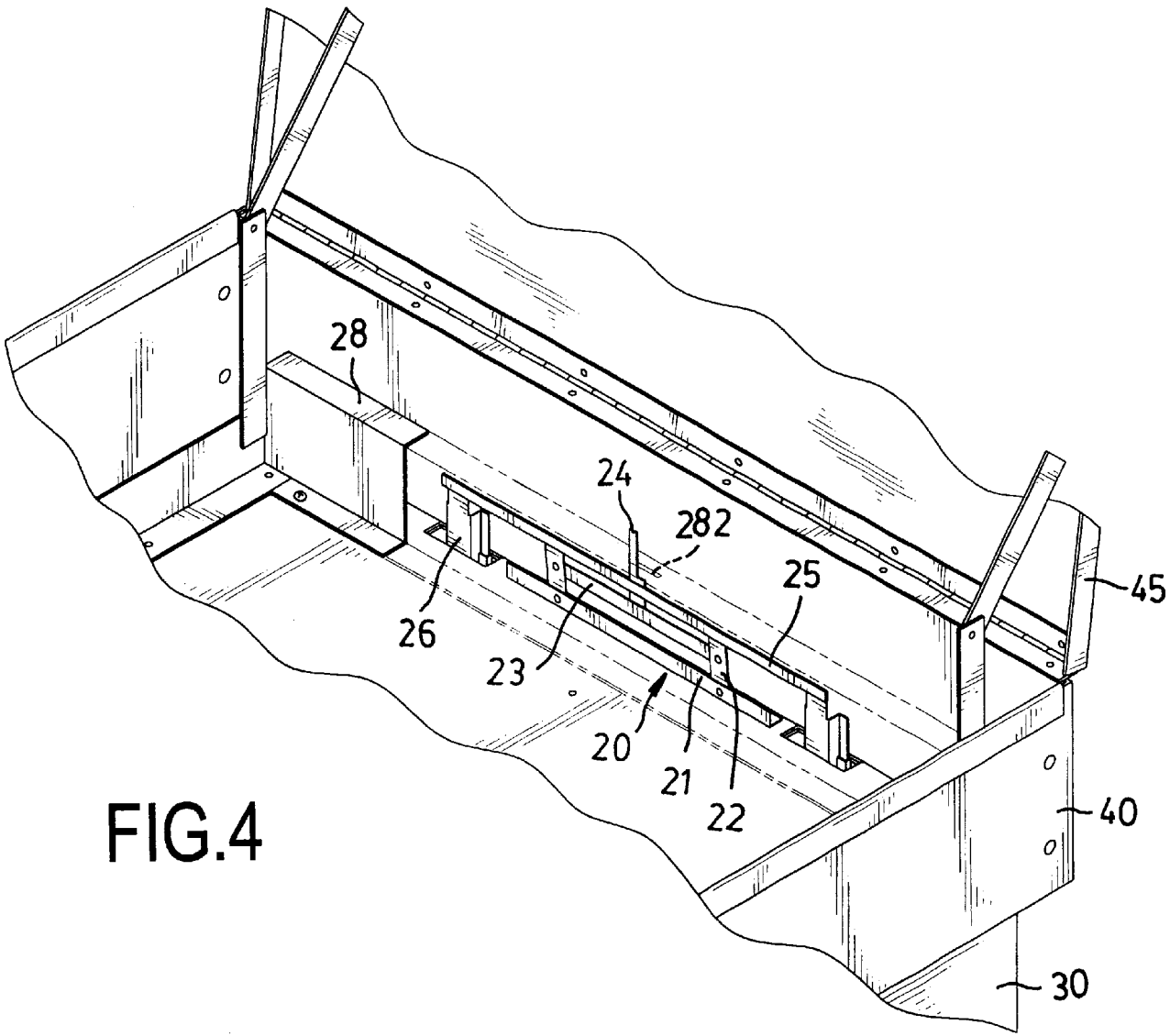
FIG. 4 is an enlarged perspective view of part of the upper case with the locking device of the tool cabinet in FIG. 1.
Figure 5:
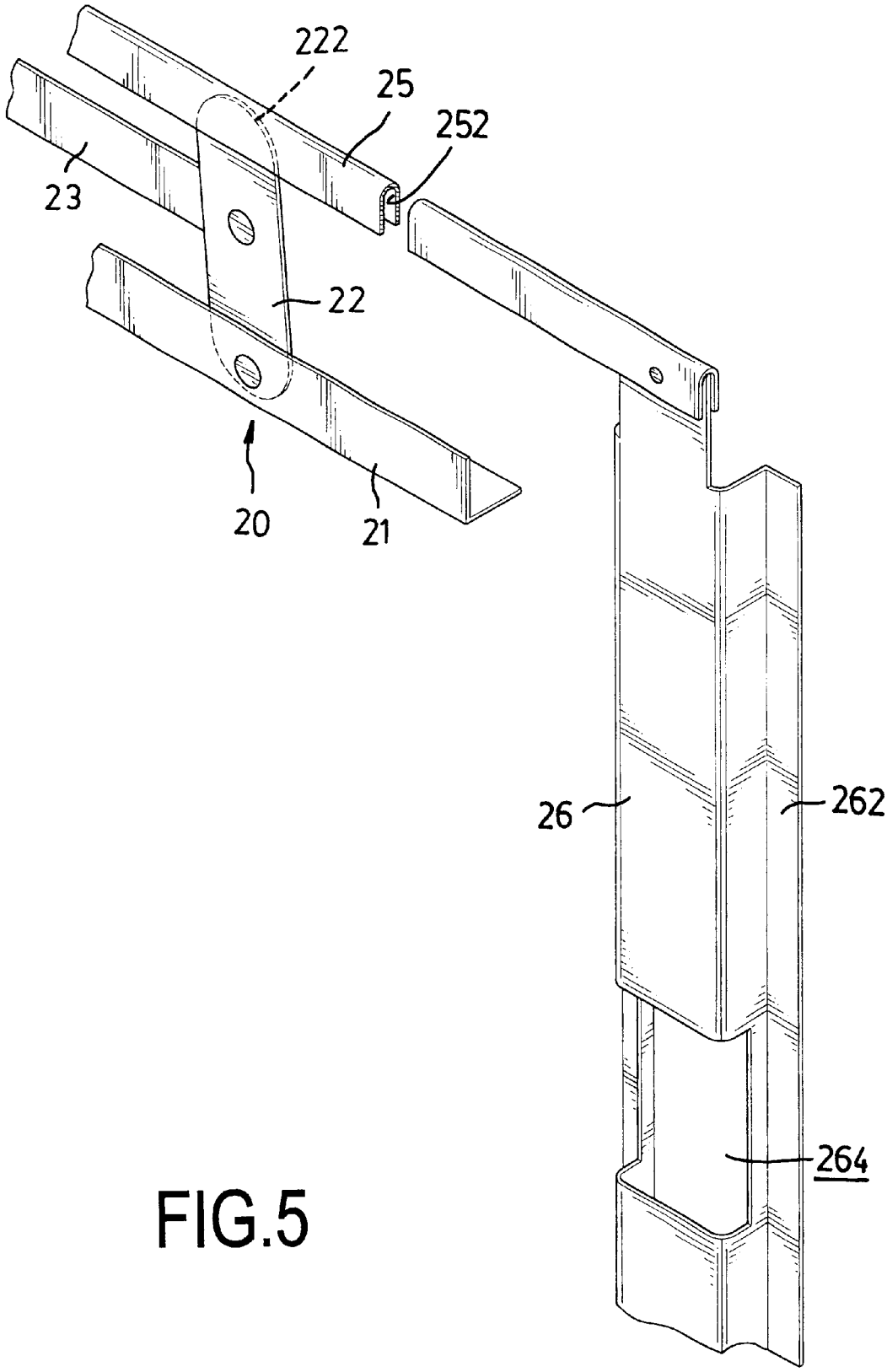
FIG. 5 is an enlarged perspective view of part of the locking device of the tool cabinet in FIG. 2.
Figure 6:
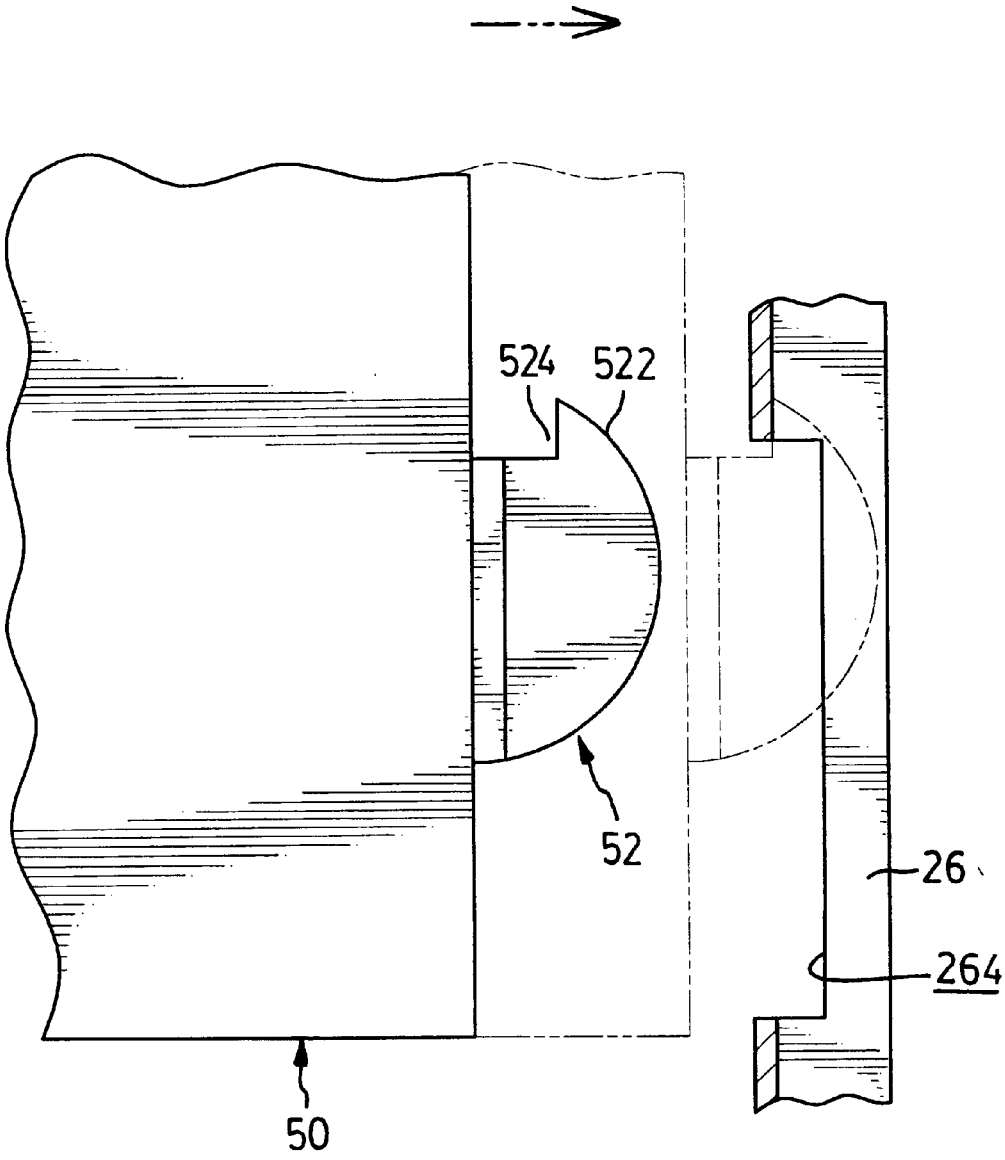
FIG. 6 is an operational side plan view in partial cross section of part of the locking device of the tool cabinet in FIG. 2.
Figure 7:
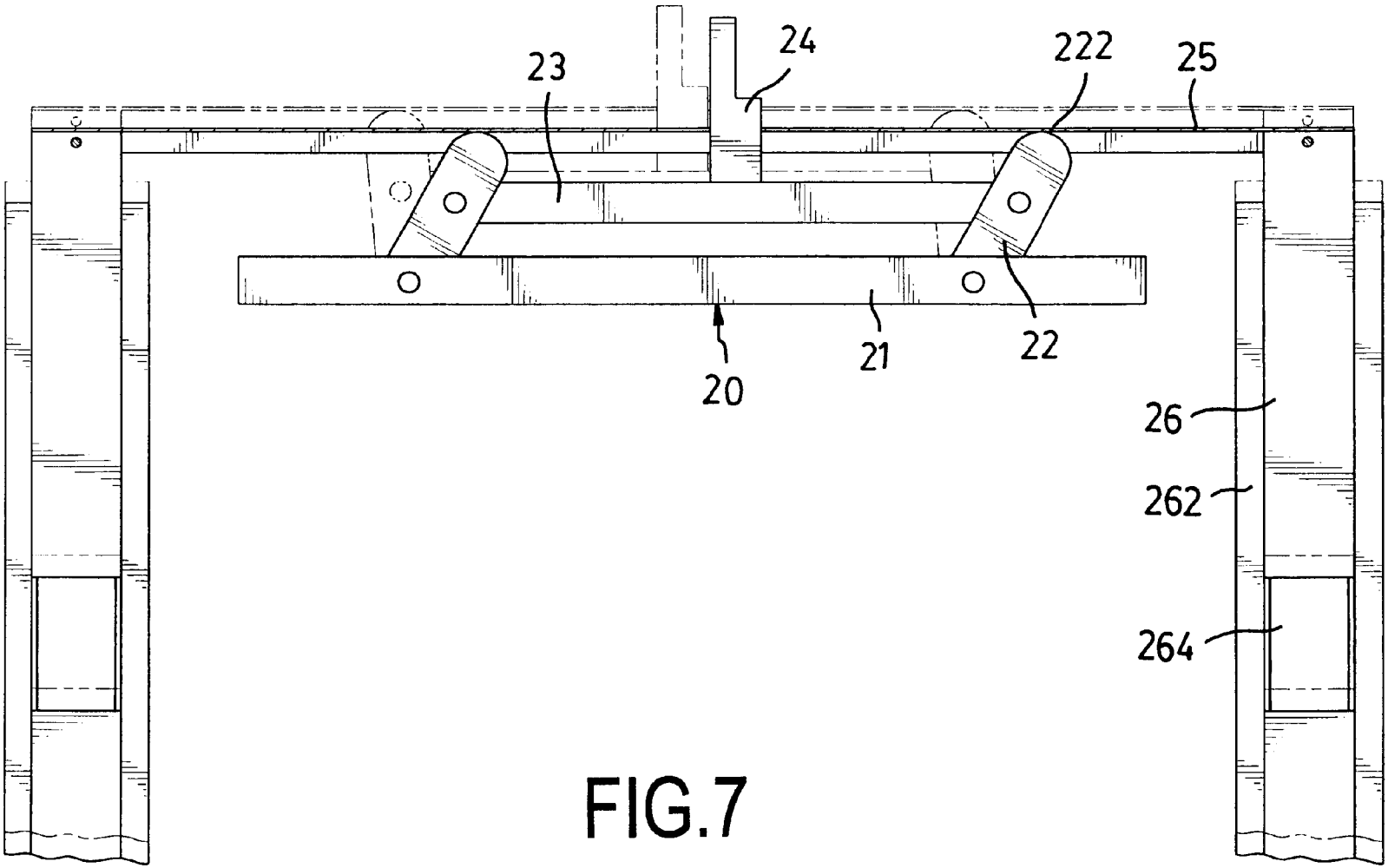
FIG. 7 is an operational side plan view of the locking device of the tool cabinet in FIG. 2.
Figure 8:
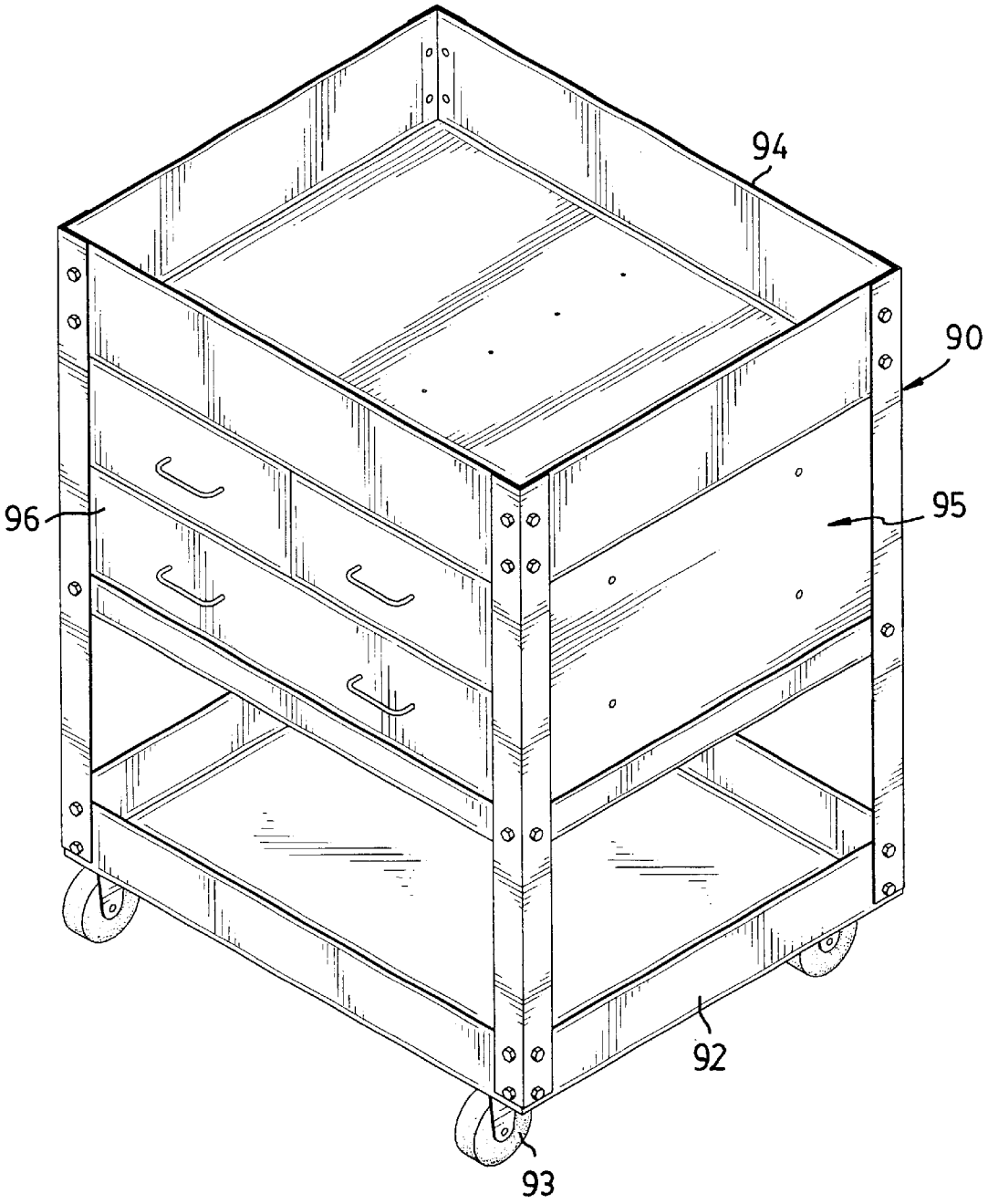
FIG.8 PRIOR ART
FIG. 8 is a perspective view of a conventional tool cabinet in accordance with the prior art.

With reference to FIGS. 1 to 3, a tool cabinet in accordance with the present invention comprises a stand (10), a drawer frame (30), an upper case (40), multiple drawers (50) and a locking device (20). The stand (10) comprises a bottom case (16), four posts (11), two side bars (12) and a front bar (13). A recess (162) to receive tools is defined in the top of the bottom case (16). Multiple wheels (17) are rotatably attached to the bottom of the bottom case (16), such that the cabinet can be freely and easily moved to any desired place. The posts (11) extend upward from the top of the bottom case (16). The side bars (12) are laterally attached to the posts (11) and parallel to each other. Each side bar (12) has multiple inserting bores (126) defined through the side bar (12), such that tools can be inserted into and held in the inserting bores (126) in the side bars (12). An extension (122) laterally extends from one side of each side bar (12) facing to the other.

The front bar (13) is attached between two of the posts (11) and is perpendicular to the side bars (12). An extension (132) laterally extends from one side of the front bar (13) to support the drawer fame (30) in cooperation with the extensions (122) on the side bars (12). A handle (14) is attached between two of the posts (11) for a user to conveniently push the cabinet.

The drawer frame (30) is attached to the stand (10) and is supported on the extensions (122,132) on the side bars (12) and the front bar (13). The drawer frame (30) comprises a base frame (31) and a wall (not numbered). The base frame (31) is composed of four rods so as to form the base frame (31) as a rectangular hollow frame. The wall is attached on the base frame (31), and the wall has three sides including a back side and two opposite sides so as to define an opening in the wall. A chamber (32) is defined between the base frame (31) and the wall to receive the drawers (50). Multiple rails (33) are attached between opposite sides of the wall and correspond to the drawers (50). Two channels (35) are defined in the back side of the wall and are parallel to each other. A top ear (36) laterally extends from each respective side of the wall.

The upper case (40) is attached to the top ears (36) on the side walls of the drawer frame (30) and has a chamber defined in the upper case (40) for receiving tools. The upper case (40) has a bottom (41), and multiple inserting bores (47) are defined in the bottom (41) of the upper case (40) for tools being inserted into and held in the inserting bores (47). Multiple hooks (42) are mounted on the bottom (41) of the upper case (40) to engage with one of the top ears (36) on the drawer frame (30). The upper case (40) is securely attached to the drawer frame (30) by means of the engagements between the hooks (42) and the top ears (36). A skirt (43) extends downward around the top of the upper case (30) to engage with the tops of the posts (11) of the stand (10).

A cover (45) is pivotally attached to the top of the upper case (40) to close the chamber in the upper case (40), and two connecting arms (44) are pivotally connected between the upper case (40) and the cover (45).

The drawers (50) are moveably received in the chamber (32) of the drawer frame (30) and each has a room for storing and holding tools. Each drawer (50) is slidably attached between two corresponding rails (33) on the opposite sides of the wall of the drawer frame (30).

With reference to FIGS. 2 and 4 to 7, the locking device (20) is mounted in the upper case (40) to hold the drawers (50) in place. The locking device (20) comprises a base bar (21), two levers (22), a connecting bar (23), an upper bar (25), two locking bars (26) and multiple locking tabs (52). The base bar (21) is mounted on the upper case (40). The levers (22) are pivotally attached to the base bar (21) and are parallel to each other. Each lever (22) has a top end, and the top end of each lever is a round end (222). The connecting bar (23) is pivotally connected between the two levers (22) and is parallel to the base bar (21). Accordingly, a parallel four-bar assembly composed of the base bar (21), the two levers (22) and the connecting bar (23) is achieved. When the connecting bar (23) is laterally moved, the levers (22) will pivotally rotate relative to the base bar (21) in parallel. For conveniently moving the connecting bar (23), a tab (24) is mounted on the connecting bar (23).

The upper bar (25) is moveably mounted in the upper case (40) and is supported on the round ends (222) of the levers (22). A channel (252) is defined in the bottom of the upper bar (25) for receiving the round ends (222) of the levers (22). Accordingly, when the levers (22) pivotally rotate relative to the base bar (21), the upper bar (25) will be actuated to move upward or downward relative to the upper case (40) by the levers (22).

The locking bars (26) are attached to the upper bar (25) and are moveably received in the channels (35) in the drawer frame (30). Two wings (262) extend from two sides of each locking bar (26) to be slidably received in the corresponding channel (35) in the drawer frame (30), such that the locking bar (26) can slide relative to the drawer frame (30) along the corresponding channel (35). Each respective locking bar (26) has multiple locking holes (264) respectively corresponding to the drawers (50).

Each locking tab (52) is attached to one of the drawers (50) and corresponds to one of the locking holes (264) in the locking bars (26) to engage with the corresponding locking hole (264). Each locking tab (52) has an arcuate edge (522) facing the corresponding locking hole (264) and a notch (524) defined in the top of the locking tab (52).

In addition, a casing (28) is secured to the upper case (40) to enclose the base bar (21), the levers (22), the connecting bar (23) and the upper bar (25). A slot (282) is defined through the casing (28) for the tab (24) extending out from the casing (28) through the slot (282).

When each drawer (50) is completely received in the chamber (32) of the drawer frame (30), the arcuate edge (522) of the tab (52) on the drawer (50) will push the corresponding locking bar (26) to move upward along the channel (35) in the drawer frame (30). Accordingly, the notch (524) in the tab (52) will automatically engage with the corresponding locking hole (264), and a locking effect is provided to the drawer (50). Consequently, the drawer (50) can be kept from unintentionally sliding out from the drawer frame (30) by means of the engagement between the locking tab (52) and the corresponding locking hole (264). This can keep any person near the cabinet from being injured by the sliding drawer with tools, and the safety of using and transporting the tool cabinet is improved.

When the user wants to use the tools stored in the drawers (50), the tab (24) is pushed along the slot (282) in the casing (28). The connecting bar (23) will be pushed to move so as to actuate the levers (22) to pivotally rotate relative to the base bar (21). The round ends (222) of the levers (22) will push the upper bar (25) to move upward, such that the locking holes (264) in the locking bars (26) will leave the position where the locking holes (264) engage with the locking tabs (52) on the drawers (50). Accordingly, the locking effect to all of the drawers (50) will be released simultaneously, and the drawers (50) can be pulled out from the drawer frame (30) for the user to access the tools stored in the drawers (50).

When the tab (24) is released, the upper bar (25) will move downward due to the weight of the upper bar (25). The locking bars (26) will also automatically move downward with the upper bar (25) to a position where the locking holes (264) align with the locking tabs (52) on the drawers (50). The locking tabs (52) will automatically engage with the corresponding locking holes (264) when the drawers (50) are pushed into the drawer frame (30) completely.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A tool cabinet comprising:

a stand;

a drawer frame attached to the stand and having a top;

an upper case with a top and a bottom attached to the top of the drawer frame;

multiple drawers moveably mounted in the drawer frame; and a locking device mounted in the upper case to hold the drawers in place and comprising:

a base bar mounted on the upper case;

two levers pivotally attached to the base bar and parallel to each other, each lever having a top end;

a connecting bar pivotally connected between the two levers and parallel to the base bar;

an upper bar with a bottom moveably mounted in the upper case and supported on the top ends of the levers;

at least one locking bar attached to the upper bar and moveably attached to the drawer frame, each respective at least one locking bar having multiple locking holes respectively corresponding to the drawers; and a locking tab with a top attached to each respective drawer and corresponding to one of the locking holes in the at least one locking bar to engage with the corresponding locking hole.

2. The tool cabinet as claimed in claim 1, wherein the top end of each lever is a round end.

3. The tool cabinet as claimed in claim 1, wherein a channel is defined in the bottom of the upper bar for receiving the top ends of the levers.

4. The tool cabinet as claimed in claim 1, further comprising a casing secured to the upper case to enclose the base bar, the levers, the connecting bar and the upper bar and having a slot defined through the casing; and a tab extending from the connecting bar and through the slot in the casing.

5. The tool cabinet as claimed in claim 1, wherein the drawer frame has a channel corresponding to each respective at least one locking bar; and each at least one locking bar has two wings extending from two sides of the at least one locking bar to be slidably received in the corresponding channel in the drawer frame.

6. The tool cabinet as claimed in claim 1, wherein the stand comprises a bottom case with a bottom, a top and a recess defined in the top of the bottom case;

four posts extending upward from the top of the bottom case and each having a top;

two side bars laterally attached to the posts and parallel to each other; and a front bar attached between two of the posts and perpendicular to the side bars.

7. The tool cabinet as claimed in claim 6, wherein the stand further comprises a handle attached between two of the posts.

8. The tool cabinet as claimed in claim 6, wherein the bottom case has multiple wheels rotatably attached to the bottom of the bottom case.

9. The tool cabinet as claimed in claim 6, wherein each respective side bar has multiple inserting bores defined through the side bar.

10. The tool cabinet as claimed in claim 6, wherein the upper case has a skirt extending downward around the top of the upper case to engage with the tops of the posts of the stand.

11. The tool cabinet as claimed in claim 6, wherein the drawer frame is supported on the side bars and the front bar.

12. The tool cabinet as claimed in claim 11, wherein each respective side bar has an extension laterally extending from one side of the respective side bar facing to the other side bar; and the front bar has an extension laterally extending from one side of the front bar to support the drawer frame in cooperation with the extensions on the side bars.

13. The tool cabinet as claimed in claim 12, wherein the drawer frame comprises a base frame composed of four rods;

a wall with three sides, including a back side and opposite sides, attached on the base frame and having an opening; and a pair of rails attached to the opposite sides of the wall and corresponding to each respective drawer.

14. The tool cabinet as claimed in wherein claim 13, the back side of the drawer frame has a channel corresponding to each respective at least one locking bar; and each at least one locking bar has two wings extending from two sides of the at least one locking bar to be slidably received in the corresponding channel in the drawer frame.

15. The tool cabinet as claimed in claim 13, wherein the wall has a top ear laterally extending from each respective side of the wall.

16. The tool cabinet as claimed in claim 15, wherein the upper case has multiple hooks mounted on the bottom of the upper case to engage with one of the top ears on the drawer frame.

17. The tool cabinet as claimed in claim 15, wherein the upper case has multiple inserting bores defined through the bottom of the upper case.

18. The tool cabinet as claimed in claim 1, further comprising a cover pivotally attached to the top of the upper case to close the upper case.

19. The tool cabinet as claimed in claim 1, wherein each locking tab has an arcuate edge facing a corresponding one of the locking holes and a notch defined in the top of the locking tab to engage with the corresponding locking hole.

* * * * *